US007913589B2

(12) United States Patent
Chen

(10) Patent No.: US 7,913,589 B2
(45) Date of Patent: Mar. 29, 2011

(54) ADJUSTABLE WRENCH THAT CLAMPS A WORKPIECE EXACTLY AND TIGHTLY

(76) Inventor: Chen-Tsung Chen, Jiali Township, Tainan County (TW)

( * ) Notice: Subject to any disclaimer, the term of this patent is extended or adjusted under 35 U.S.C. 154(b) by 234 days.

(21) Appl. No.: 12/272,076

(22) Filed: Nov. 17, 2008

(65) Prior Publication Data

US 2010/0122610 A1 May 20, 2010

(51) Int. Cl.
*B25B 13/28* (2006.01)

(52) U.S. Cl. ..... 81/99; 81/90.3

(58) Field of Classification Search .... 81/99, 90.3–90.8, 81/65.2, 64, 58.5, 91.2
See application file for complete search history.

(56) References Cited

U.S. PATENT DOCUMENTS 334,227 A * 1/1886 Hellem ..... 81/90.4
747,612 A * 12/1903 Jones ..... 81/90.3
1,019,280 A * 3/1912 Serfoss ..... 81/90.4
1,177,620 A * 4/1916 Hardeman ..... 81/98
1,764,124 A * 6/1930 Smith ..... 81/90.4
2,448,221 A * 8/1948 Jones ..... 81/90.4
2,847,888 A * 8/1958 Paulson ..... 81/90.4
3,097,552 A * 7/1963 Kelley ..... 81/90.5
5,957,010 A * 9/1999 Petts ..... 81/111
6,286,398 B1 * 9/2001 Huang ..... 81/90.1
6,978,701 B1 * 12/2005 Buchanan ..... 81/98

* cited by examiner

*Primary Examiner* — David B Thomas
(74) *Attorney, Agent, or Firm* — Alan Kamrath; Kamrath & Associates PA

(57) ABSTRACT

A wrench includes a handle, and a driving unit pivotally mounted on the handle. The handle has an end portion provided with a support surface. The driving unit includes a first jaw having a first end pivotally mounted on the end portion of the handle, and a second jaw having a first end pivotally connected with a second end of the first jaw and a second end that is movable to abut the support surface of the handle and the first end of the first jaw. Thus, the second end of the second jaw abuts the support surface of the handle tightly and closely so that the force applied by a user is transmitted to the wrench directly so as to drive the wrench to operate the workpiece in an energy-saving manner.

15 Claims, 10 Drawing Sheets

ADJUSTABLE WRENCH THAT CLAMPS A WORKPIECE EXACTLY AND TIGHTLY

BACKGROUND OF THE INVENTION

1. Field of the Invention

The present invention relates to a wrench and, more particularly, to a wrench for operating a workpiece, such as a bolt, nut and the like.

2. Description of the Related Art

A conventional wrench comprises a handle having a first end provided with an open drive head and a second end provided with a box drive head. Thus, the wrench can be used to operate a workpiece, such as a bolt, nut and the like. However, when the wrench is used in a narrower space, such as the inside of a car engine and the like, the wrench cannot be used to operate the workpiece easily and quickly, thereby causing inconvenience to a user when operating the wrench in the narrower space.

BRIEF SUMMARY OF THE INVENTION

In accordance with the present invention, there is provided a wrench, comprising a handle, and a driving unit pivotally mounted on and movable relative to the handle. The handle has an end portion provided with a support surface. The driving unit includes a first jaw pivotally connected with the handle and having a first end pivotally mounted on the end portion of the handle, and a second jaw pivotally connected with the first jaw and having a first end pivotally connected with a second end of the first jaw and a second end that is movable to abut the support surface of the handle and the first end of the first jaw.

The primary objective of the present invention is to provide an adjustable wrench that clamps a workpiece exactly and tightly.

Another objective of the present invention is to provide a wrench, wherein the second end of the second jaw abuts the support surface of the handle tightly and closely so that the force applied by a user is transmitted to the wrench directly and exactly so as to drive the wrench to operate the workpiece in an energy-saving manner.

A further objective of the present invention is to provide a wrench, wherein the reaction of the workpiece applied on the wrench is shared by and evenly distributed on the support surface of the handle, the first jaw of the driving unit and the second jaw of the driving unit to prevent from incurring a stress concentration, thereby prevent the wrench from being worn out or broken due to an excessive force.

A further objective of the present invention is to provide a wrench, wherein the second end of the second jaw abuts the support surface of the handle tightly and closely by the elastic force of the elastic member and the restoring member, so that the workpiece is clamped by the first jaw and the second jaw of the driving unit exactly to prevent the workpiece from being detached from the wrench.

A further objective of the present invention is to provide a wrench, wherein the second end of the second jaw abuts the support surface of the handle tightly and closely by the magnetically attractive force of the first magnet and the second magnet, so that the workpiece is clamped by the first jaw and the second jaw of the driving unit exactly to prevent the workpiece from being detached from the wrench.

A further objective of the present invention is to provide a wrench, wherein the second end of the second jaw has a periphery fully encompassed by the mounting groove of the support surface, so that the second end of the second jaw is combined with the support surface of the handle exactly and closely to facilitate the user operating the wrench.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
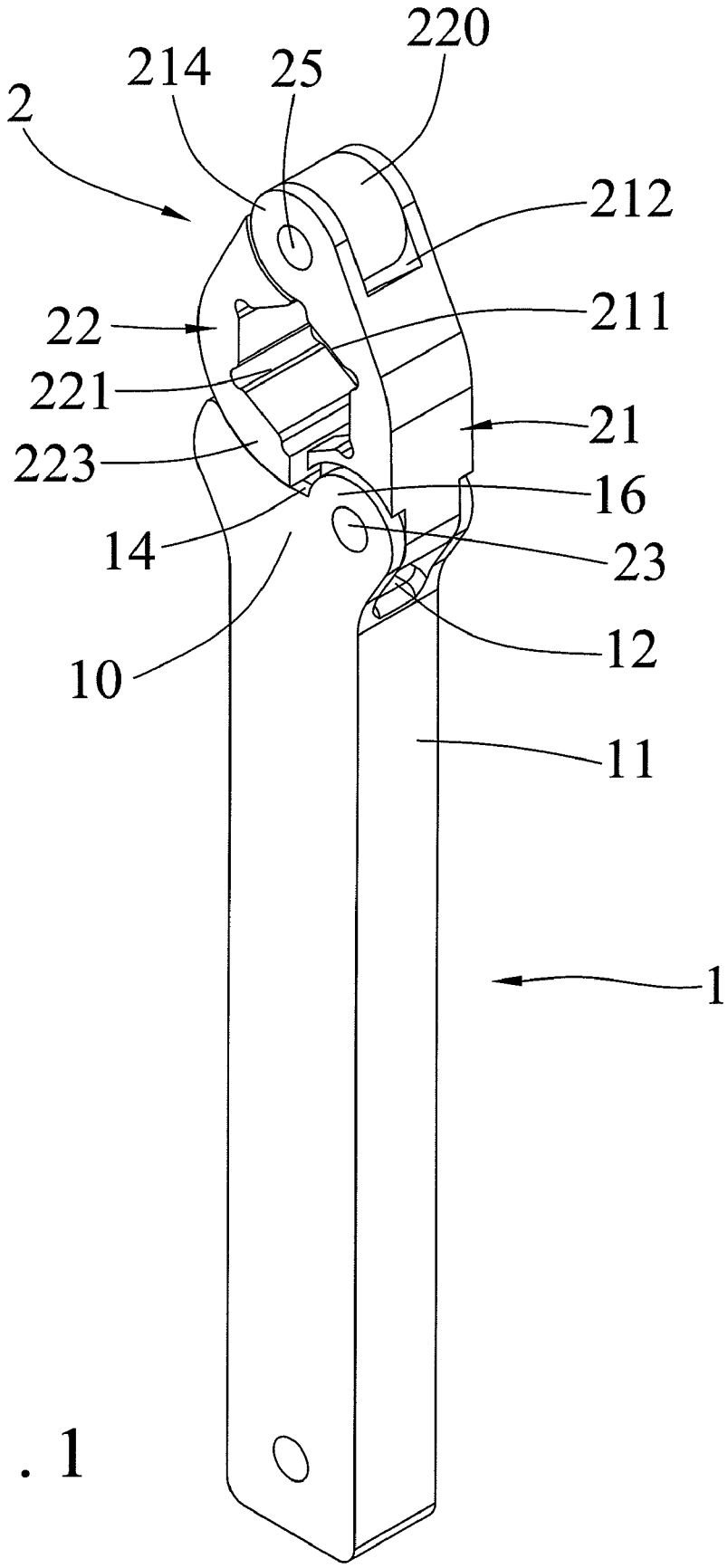
FIG. 1 is a perspective view of a wrench in accordance with the preferred embodiment of the present invention.
Figure 2:
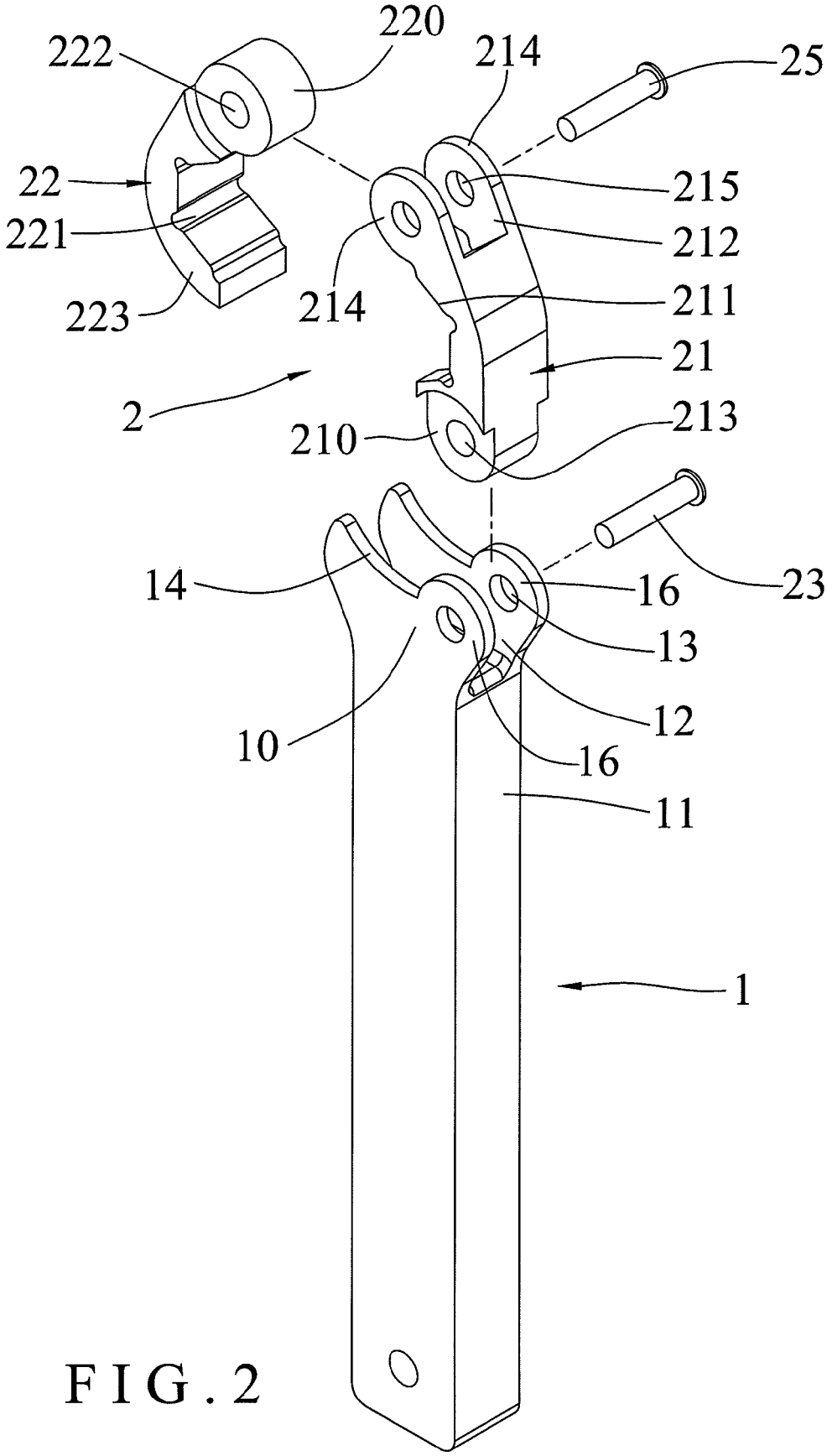
FIG. 2 is an exploded perspective view of the wrench as shown in FIG. 1.
Figure 3:
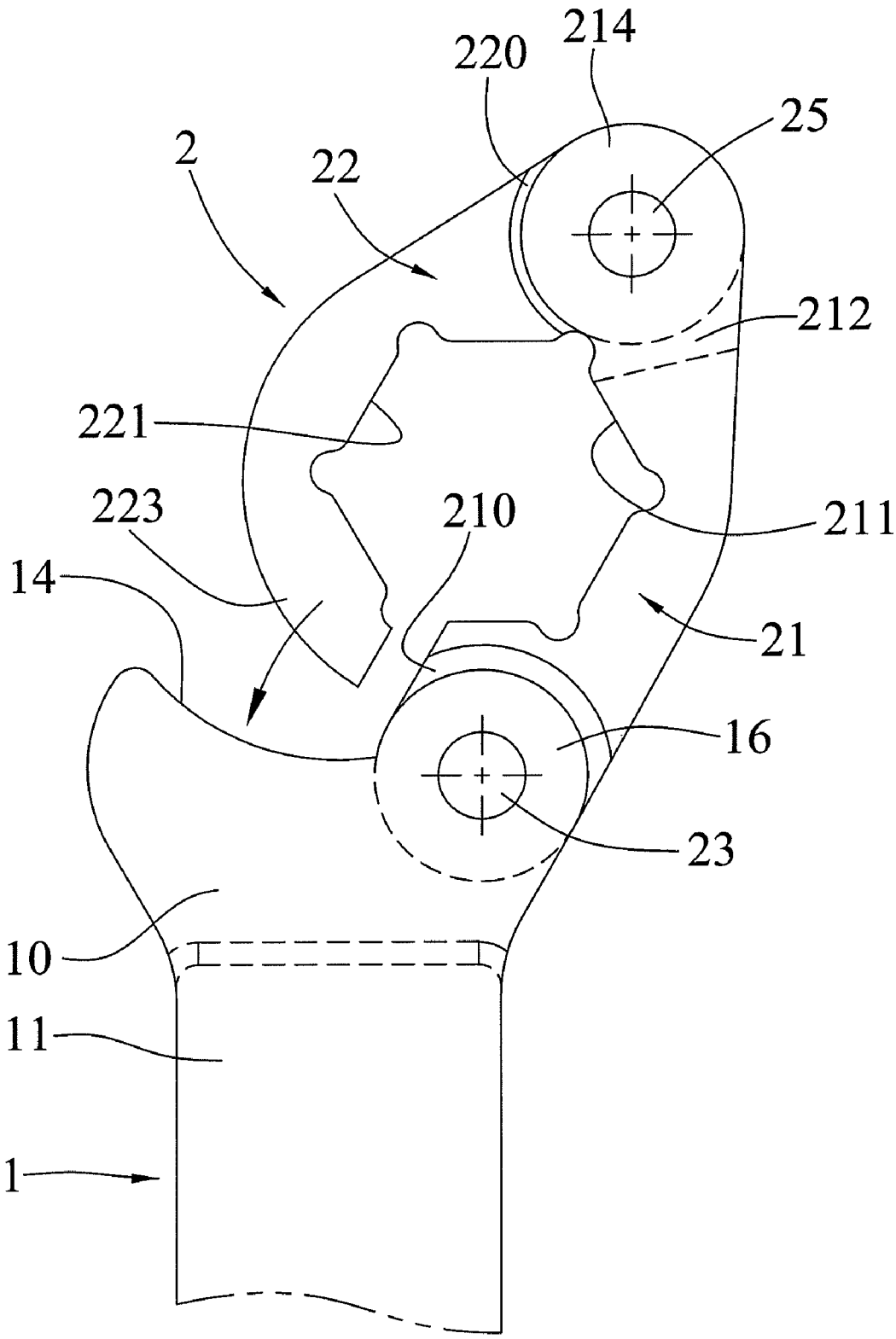
FIG. 3 is a front operational view of the wrench as shown in FIG. 1.

Referring to the drawings and initially to FIGS. 1-3, a wrench in accordance with the preferred embodiment of the present invention comprises a handle 1, and a driving unit 2 pivotally mounted on and movable relative to the handle 1.

The handle 1 has an end portion 11 provided with a support surface 14. The end portion 11 of the handle 1 has a forked shape and has two opposite sidewalls 10 protruding outwardly and each having a first side provided with a pivot ear 16 and a second side provided with the support surface 14. The pivot ear 16 of the end portion 11 of the handle 1 is provided with a fixing hole 13. The end portion 11 of the handle 1 is provided with a receiving chamber 12 located between the two opposite sidewalls 10. The support surface 14 of the handle 1 has a substantially concave shape and has an opening directed toward the driving unit 2.

The driving unit 2 includes a first jaw 21 pivotally connected with the handle 1 and having a first end 210 pivotally mounted on the end portion 11 of the handle 1, and a second jaw 22 pivotally connected with the first jaw 21 and having a first end 220 pivotally connected with a second end 214 of the first jaw 21 and a second end 223 that is movable to abut the support surface 14 of the handle 1 and the first end 210 of the first jaw 21.

The first jaw 21 of the driving unit 2 has an inner side provided with a first clamping face 211 located between the first end 210 and the second end 214 of the first jaw 21. The first end 210 of the first jaw 21 is pivotally mounted in the receiving chamber 12 of the handle 1 and is located between the two opposite sidewalls 10 of the handle 1. The first end 210 of the first jaw 21 is provided with a pivot hole 213. The second end 214 of the first jaw 21 has a forked shape and has two opposite sidewalls each provided with a fixing bore 215. The second end 214 of the first jaw 21 is provided with a mounting recess 212 located between the two opposite sidewalls of the first jaw 21.

The second jaw 22 of the driving unit 2 has an inner side provided with a second clamping face 221 located between the first end 220 and the second end 223 of the second jaw 22 and facing the first clamping face 211 of the first jaw 21. The second clamping face 221 of the second jaw 22 is movable to combine with the first clamping face 211 of the first jaw 21, so that the second clamping face 221 of the second jaw 22 co-operates with the first clamping face 211 of the first jaw 21 to form a substantially polygonal driving face as shown in FIG. 1. The first end 220 of the second jaw 22 is pivotally mounted in the mounting recess 212 of the first jaw 21. The first end 220 of the second jaw 22 is provided with a pivot bore 222. The second end 223 of the second jaw 22 has a substantially convex shape.

The driving unit 2 further includes a pivot pin 23 extending through the fixing hole 13 of the handle 1 and the pivot hole 213 of the first jaw 21 so that the first end 210 of the first jaw 21 is pivotally mounted on the end portion 11 of the handle 1, and a pivot shaft 25 extending through the fixing bore 215 of the first jaw 21 and the pivot bore 222 of the second jaw 22 so that the first end 220 of the second jaw 22 is pivotally connected with a second end 214 of the first jaw 21.

In operation, again referring to FIGS. 1-3, the first jaw 21 of the driving unit 2 is pivotally mounted on the end portion 11 of the handle 1, and the second jaw 22 of the driving unit 2 is pivotally connected with the first jaw 21 of the driving unit 2, so that the first jaw 21 of the driving unit 2 is pivotable relative to the end portion 11 of the handle 1, and the second jaw 22 of the driving unit 2 is movable relative to the first jaw 21 of the driving unit 2 as shown in FIG. 3. In such a manner, when the second clamping face 221 of the second jaw 22 is moved to combine with the first clamping face 211 of the first jaw 21, the second clamping face 221 of the second jaw 22 co-operates with the first clamping face 211 of the first jaw 21 to form a substantially hexagonal driving face as shown in FIG. 1 to clamp a workpiece 4 (see FIG. 6), such as a bolt, nut and the like. Then, the end portion 11 of the handle 1 is pivoted relative to the driving unit 2 until the second end 223 of the second jaw 22 is moved to abut the support surface 14 of the handle 1 as shown in FIG. 1. Thus, the first jaw 21 of the driving unit 2 is positioned on the end portion 11 of the handle 1 by the pivot pin 23, and the second end 223 of the second jaw 22 is locked by the support surface 14 of the handle 1, so that the end portion 11 of the handle 1 is combined with the first jaw 21 and the second jaw 22 of the driving unit 2 to operate the workpiece 4.

Figure 4:
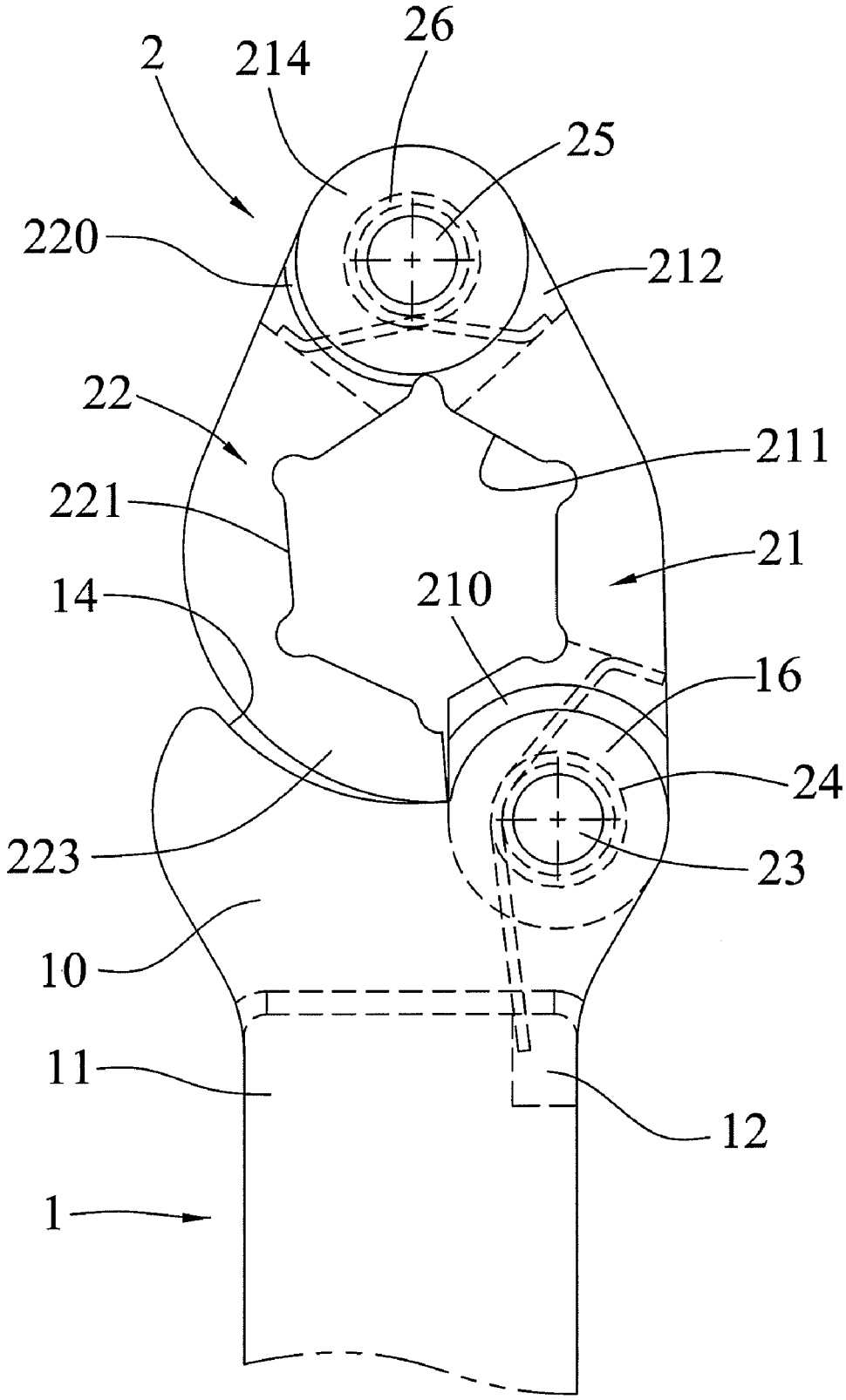
FIG. 4 is a front view of a wrench in accordance with another preferred embodiment of the present invention.
Figure 5:
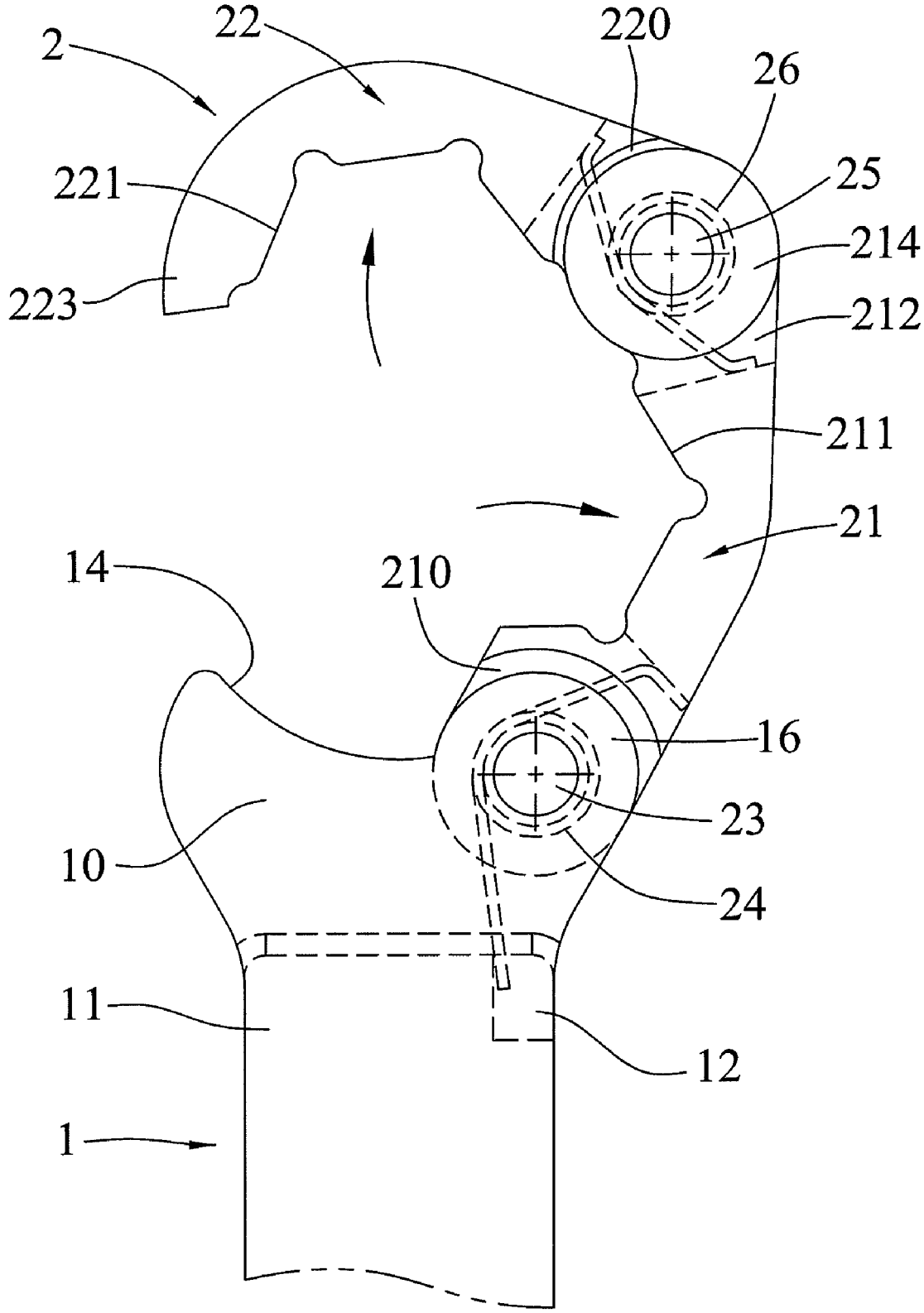
FIG. 5 is a schematic operational view of the wrench as shown in FIG. 4.
Figure 6:
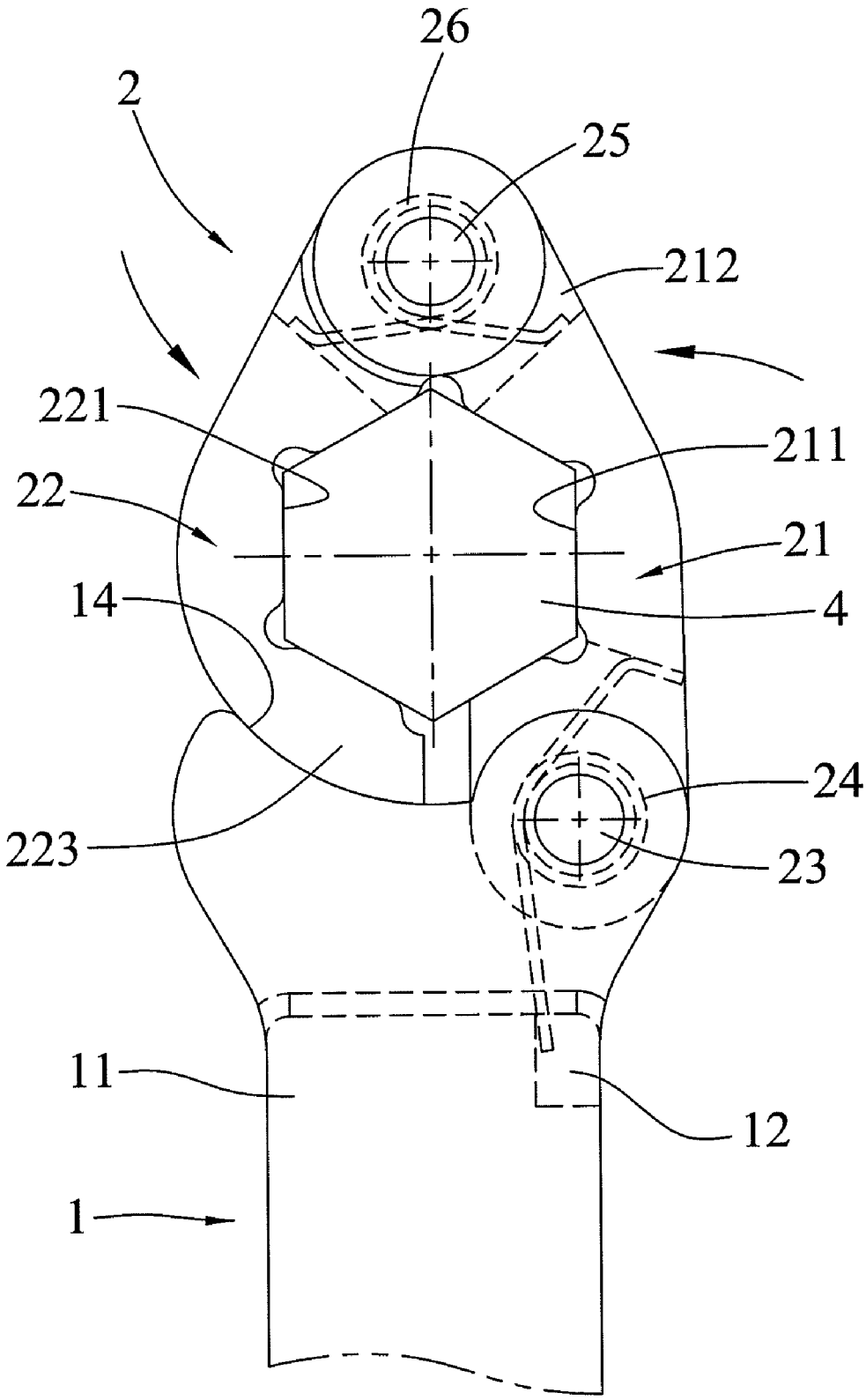
FIG. 6 is a schematic operational view of the wrench as shown in FIG. 4.

Referring to FIGS. 4-6, the driving unit 2 further includes an elastic member 24 mounted on the pivot pin 23 and biased between the end portion 11 of the handle 1 and the first end 210 of the first jaw 21 to push the first jaw 21 of the driving unit 2 toward the support surface 14 of the handle 1, and a restoring member 26 mounted on the pivot shaft 25 and biased between the second end 214 of the first jaw 21 and the first end 220 of the second jaw 22 to push the second jaw 22 of the driving unit 2 toward the support surface 14 of the handle 1 and the first jaw 21 of the driving unit 2. The elastic member 24 is received in the receiving chamber 12 of the handle 1, and the restoring member 26 is received in the mounting recess 212 of the first jaw 21.

Figure 7:
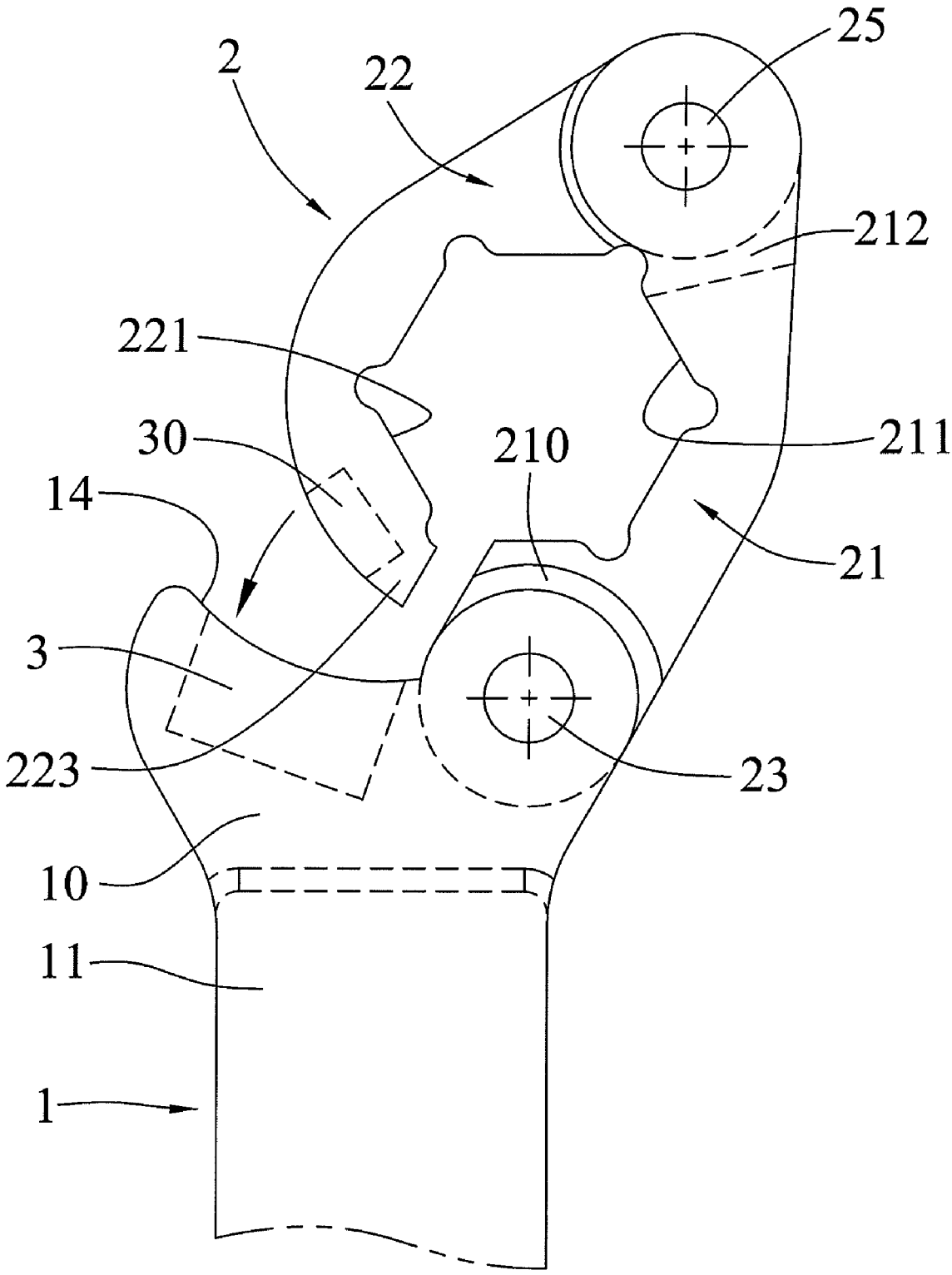
FIG. 7 is a front view of a wrench in accordance with another preferred embodiment of the present invention.
Figure 8:
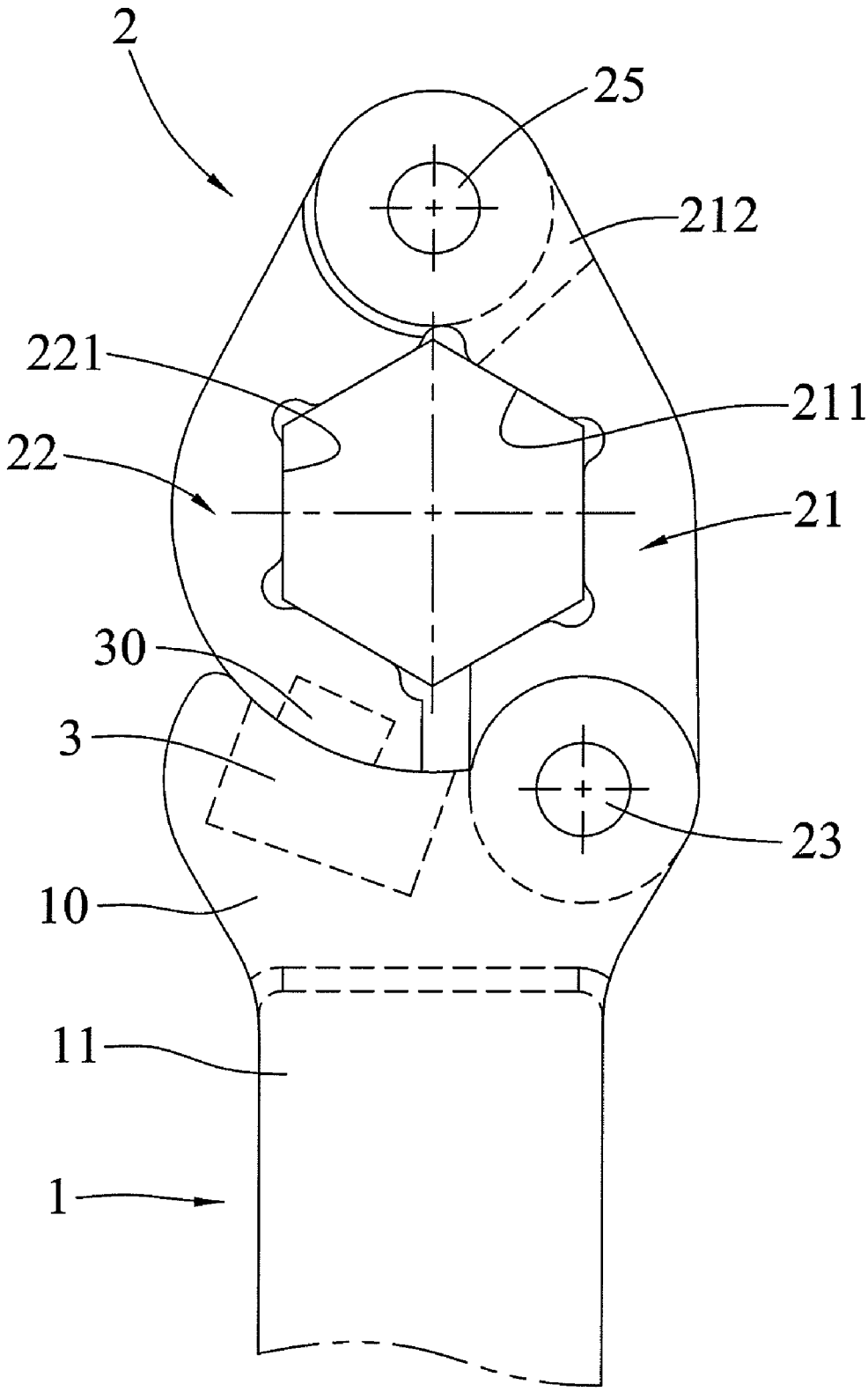
FIG. 8 is a schematic operational view of the wrench as shown in FIG. 7.

Referring to FIGS. 7 and 8, the wrench further comprises a first magnet 3 mounted in the support surface 14 of the handle 1, and a second magnet 30 mounted in the second end 223 of the second jaw 22 and movable to abut the first magnet 3 so that the second end 223 of the second jaw 22 is combined with the support surface 14 of the handle 1 exactly and closely.

Figure 9:
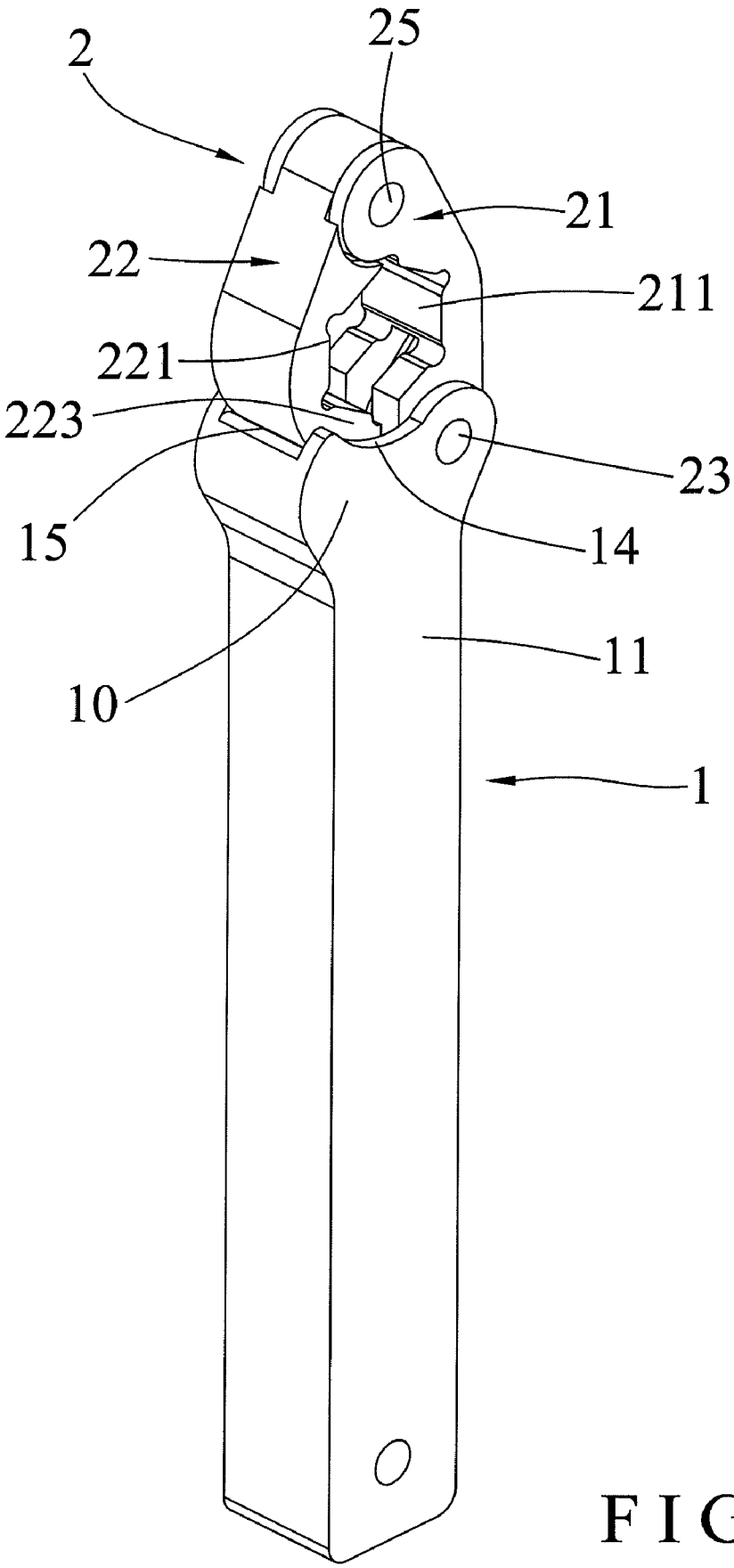
FIG. 9 is a perspective view of a wrench in accordance with another preferred embodiment of the present invention.
Figure 10:
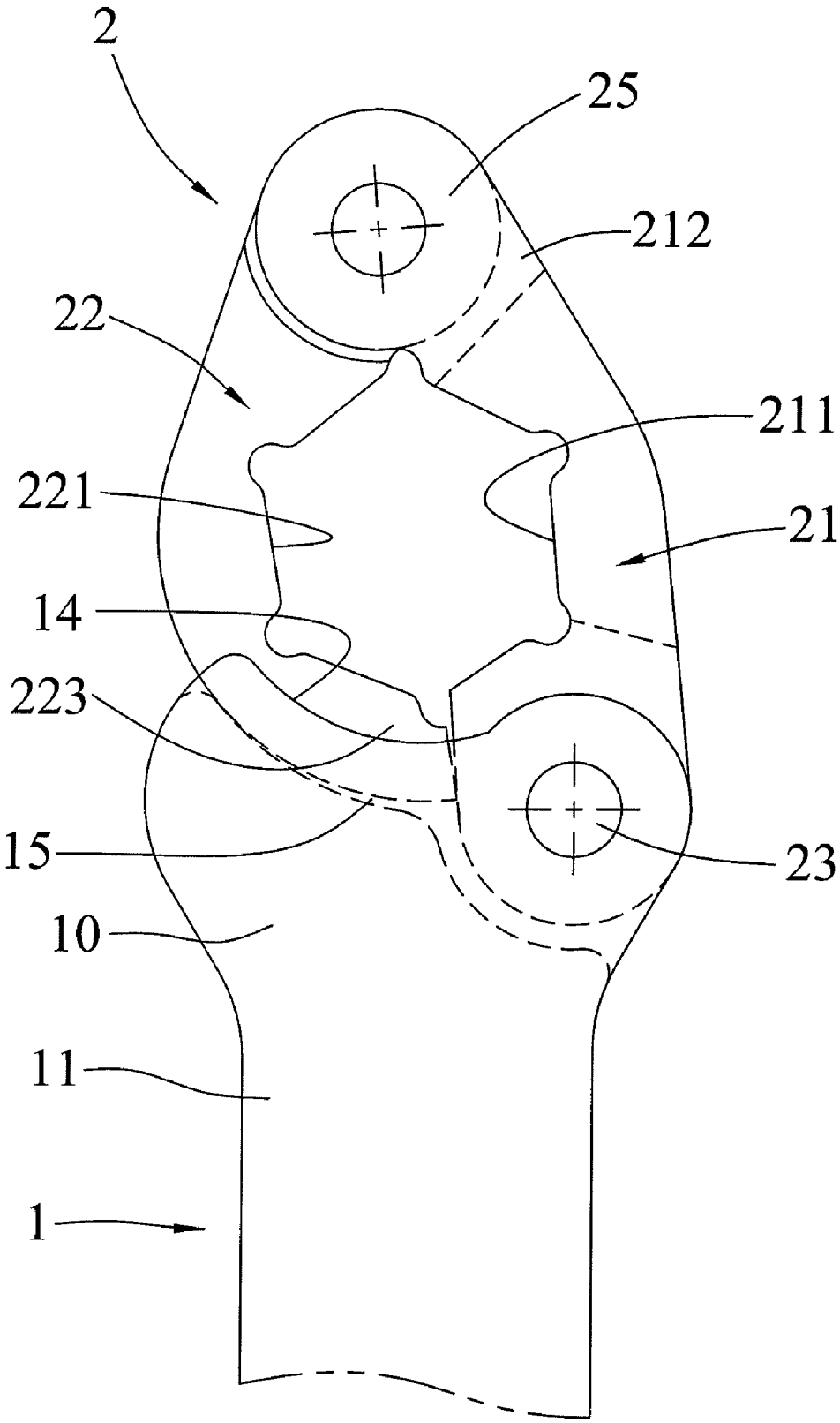
FIG. 10 is a front view of the wrench as shown in FIG. 9.

Referring to FIGS. 9 and 10, the support surface 14 of the handle 1 is provided with a mounting groove 15 to receive the second end 223 of the second jaw 22. The mounting groove 15 of the support surface 14 of the handle 1 has a substantially U-shaped cross-sectional profile, and the second end 223 of the second jaw 22 has a periphery fully encompassed by the mounting groove 15 of the support surface 14, so that the second end 223 of the second jaw 22 is combined with the support surface 14 of the handle 1 exactly and closely.

Accordingly, the second end 223 of the second jaw 22 abuts the support surface 14 of the handle 1 tightly and closely so that the force applied by a user is transmitted to the wrench directly and exactly so as to drive the wrench to operate the workpiece 4 in an energy-saving manner. In addition, the reaction of the workpiece 4 applied on the wrench is shared by and evenly distributed on the support surface 14 of the handle 1, the first jaw 21 of the driving unit 2 and the second jaw 22 of the driving unit 2 to prevent from incurring a stress concentration, thereby prevent the wrench from being worn out or broken due to an excessive force. Further, the second end 223 of the second jaw 22 abuts the support surface 14 of the handle 1 tightly and closely by the elastic force of the elastic member 24 and the restoring member 26, so that the workpiece 4 is clamped by the first jaw 21 and the second jaw 22 of the driving unit 2 exactly to prevent the workpiece 4 from being detached from the wrench. Further, the second end 223 of the second jaw 22 abuts the support surface 14 of the handle 1 tightly and closely by the magnetically attractive force of the first magnet 3 and the second magnet 30, so that the workpiece 4 is clamped by the first jaw 21 and the second jaw 22 of the driving unit 2 exactly to prevent the workpiece 4 from being detached from the wrench. Further, the second end 223 of the second jaw 22 has a periphery fully encompassed by the mounting groove 15 of the support surface 14, so that the second end 223 of the second jaw 22 is combined with the support surface 14 of the handle 1 exactly and closely to facilitate the user operating the wrench.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A wrench, comprising:

a handle;

a driving unit pivotally mounted on and movable relative to the handle;

wherein the handle has an end portion provided with a support surface;

the driving unit includes:

a first jaw pivotally connected with the handle and having a first end pivotally mounted on the end portion of the handle;

a second jaw pivotally connected with the first jaw and having a first end pivotally connected with a second end of the first jaw and a second end that is movable to abut the support surface of the handle and the first end of the first jaw;

the end portion of the handle has two opposite sidewalls protruding outwardly and each having a first side provided with a pivot ear and a second side provided with the support surface;

the pivot ear of the end portion of the handle is provided with a fixing hole;

the first end of the first jaw is provided with a pivot hole;

the driving unit further includes:

a pivot pin extending through the fixing hole of the handle and the pivot hole of the first jaw so that the first end of the first jaw is pivotally mounted on the end portion of the handle;

the end portion of the handle is provided with a receiving chamber located between the two opposite sidewalls;

the first end of the first jaw is pivotally mounted in the receiving chamber of the handle and is located between the two opposite sidewalls of the handle;

the driving unit further includes:

an elastic member mounted on the pivot pin and biased between the end portion of the handle and the first end of the first jaw to push the first jaw of the driving unit toward the support surface of the handle.

2. The wrench of claim 1, wherein the support surface of the handle has a substantially concave shape and has an opening directed toward the driving unit;

the second end of the second jaw has a substantially convex shape.

3. The wrench of claim 1, wherein the second end of the first jaw has two opposite sidewalls each provided with a fixing bore;

the first end of the second jaw is provided with a pivot bore;

the driving unit further includes:

a pivot shaft extending through the fixing bore of the first jaw and the pivot bore of the second jaw so that the first end of the second jaw is pivotally connected with a second end of the first jaw.

4. The wrench of claim 3, wherein the second end of the first jaw is provided with a mounting recess located between the two opposite sidewalls of the first jaw;

the first end of the second jaw is pivotally mounted in the mounting recess of the first jaw.

5. The wrench of claim 4, wherein the driving unit further includes:

a restoring member mounted on the pivot shaft and biased between the second end of the first jaw and the first end of the second jaw to push the second jaw of the driving unit toward the support surface of the handle and the first jaw of the driving unit.

6. The wrench of claim 5, wherein the restoring member is received in the mounting recess of the first jaw.

7. The wrench of claim 3, wherein the second end of the first jaw has a forked shape.

8. The wrench of claim 1, wherein the first jaw of the driving unit has an inner side provided with a first clamping face located between the first end and the second end of the first jaw;

the second jaw of the driving unit has an inner side provided with a second clamping face located between the first end and the second end of the second jaw and facing the first clamping face of the first jaw.

9. The wrench of claim 8, wherein the second clamping face of the second jaw is movable to combine with the first clamping face of the first jaw;

the second clamping face of the second jaw co-operates with the first clamping face of the first jaw to form a substantially polygonal driving face.

10. The wrench of claim 1, wherein the elastic member is received in the receiving chamber of the handle.

11. The wrench of claim 1, wherein the end portion of the handle has a forked shape.

12. A wrench, comprising:

a handle;

a driving unit pivotally mounted on and movable relative to the handle;

wherein the handle has an end portion provided with a support surface;

the driving unit includes:

a first jaw pivotally connected with the handle and having a first end pivotally mounted on the end portion of the handle;

a second jaw pivotally connected with the first jaw and having a first end pivotally connected with a second end of the first jaw and a second end that is movable to abut the support surface of the handle and the first end of the first jaw;

the wrench further comprises:

a first magnet mounted in the support surface of the handle;

a second magnet mounted in the second end of the second jaw and movable to abut the first magnet so that the second end of the second jaw is combined with the support surface of the handle exactly and closely.

13. A wrench, comprising:

a handle;

a driving unit pivotally mounted on and movable relative to the handle;

wherein the handle has an end portion provided with a support surface;

the driving unit includes:

a first jaw pivotally connected with the handle and having a first end pivotally mounted on the end portion of the handle;

a second jaw pivotally connected with the first jaw and having a first end pivotally connected with a second end of the first jaw and a second end that is movable to abut the support surface of the handle and the first end of the first jaw;

the support surface of the handle is provided with a mounting groove to receive the second end of the second jaw.

14. The wrench of claim 13, wherein the mounting groove of the support surface of the handle has a substantially U-shaped cross-sectional profile.

15. The wrench of claim 13, wherein the second end of the second jaw has a periphery fully encompassed by the mounting groove of the support surface, so that the second end of the second jaw is combined with the support surface of the handle exactly and closely.

* * * * *